United States Patent [19]

Williams

[11] Patent Number: 4,498,633

[45] Date of Patent: Feb. 12, 1985

[54] APPARATUS FOR PROCESSING COAL

[75] Inventor: Robert M. Williams, Ladue, Mo.

[73] Assignee: Williams Patent Crusher and Pulverizer Company, St. Louis, Mo.

[21] Appl. No.: 439,050

[22] Filed: Nov. 4, 1982

[51] Int. Cl.[3] ..... B02C 23/24

[52] U.S. Cl. ..... 241/48; 241/57; 241/60; 241/65; 241/76; 241/77; 241/79; 241/81

[58] Field of Search ..... 241/48, 57, 60, 62, 241/65, 73, 77, 79, 79.1, 76, 81; 209/139.2

[56] References Cited

U.S. PATENT DOCUMENTS

| | | | |
|---|---|---|---|
| 2,932,460 | 4/1960 | Petersen | 241/77 X |
| 3,794,251 | 2/1974 | Williams | 241/81 X |
| 3,960,714 | 6/1976 | Strauss | 209/139.2 |

*Primary Examiner*—Howard N. Goldberg
*Assistant Examiner*—Timothy V. Eley
*Attorney, Agent, or Firm*—Gravely, Lieder & Woodruff

[57] ABSTRACT

Apparatus for processing coal to prevent the creation of extreme fines and to extract pyrites from the principal coal fractions in which there are two air circulating circuits having processing components which cooperate in their respective circuits to result initially in substantial extraction of fines in the first circuit while releasing principal granulated coal fractions and pyrites to the second circuit where specific gravity separation of the pyrites and principal coal fractions occur. The apparatus includes a source of drying heat added to the air moving in the circuits and delivered at the places where surface moisture drying is most effective. Furthermore, the apparatus is operated so as to reduce coal to a desired size without creating an excessive volume of extreme fines, to separate pyrites and hard to grind components by specific gravity in a region where fines are not present, and to use the extreme fines as a source of fuel to generate drying heat.

7 Claims, 1 Drawing Figure

APPARATUS FOR PROCESSING COAL

BACKGROUND OF THE INVENTION

1. Field of the Invention

This invention pertains generally to the grinding and drying of material, such as coal, and particularly to apparatus for working material and segregating the worked material into different classifications according to specific gravity characteristics.

2. Description of the Prior Art

There are a number of types of apparatus useful for segregating grindable materials so that coarse and fine constituents can be collected at different outlets of the apparatus according to the purpose of such segregation. One such apparatus is shown in the prior patent of Williams U.S. Pat. No. 3,794,251, issued on Feb. 26, 1974. Another related apparatus is shown in Williams U.S. Pat. No. 3,981,454, issued Sept. 21, 1976 wherein segregation of material is effected by use of an air column so that advantage is taken of specific gravity characteristics of the material being processed. A further prior art patent is Williams U.S. Pat. No. 3,844,491, issued Oct. 29, 1974, wherein segregation has involved magnetic as well as specific gravity characteristics.

BRIEF DESCRIPTION OF THE INVENTION

A problem with the preparation of certain material is that there is a certain percentage of undesirable content. In coal it is the presence of iron pyrites which is a natural metallic sulfide, especially of iron. During the granulating of coal it is highly desirable to remove the heavier pyrites as soon as possible, while collecting and drying the remainder.

A general object of the present invention is to beneficiate, grind, dry and size coal with the production of a minimum of extreme fines, as the extreme fines create a problem when the granulated coal is injected into reactors or furnaces. It is also an object to provide apparatus which extracts the hard to grind fractions and collects the fines in a separate location and to retain the extreme fines for possible use as a fuel in the furnace to produce heat for the drying.

Specific objects of the present invention are to provide apparatus for processing material having different density and grindability, to provide separation of fine fractions from the coarse fractions by specific gravity, and to separate the coarse fractions into those which are desirable and those, such as the heavy pyrites which have little or no commercial value.

A presently preferred embodiment comprises two separate circulation systems and a source of heat for drying the surface moisture on the material being processed in which the material emerges from the systems at different places according to its size or relative specific gravity characteristics.

DETAILED DESCRIPTION OF THE EMBODIMENT

Figure 1:
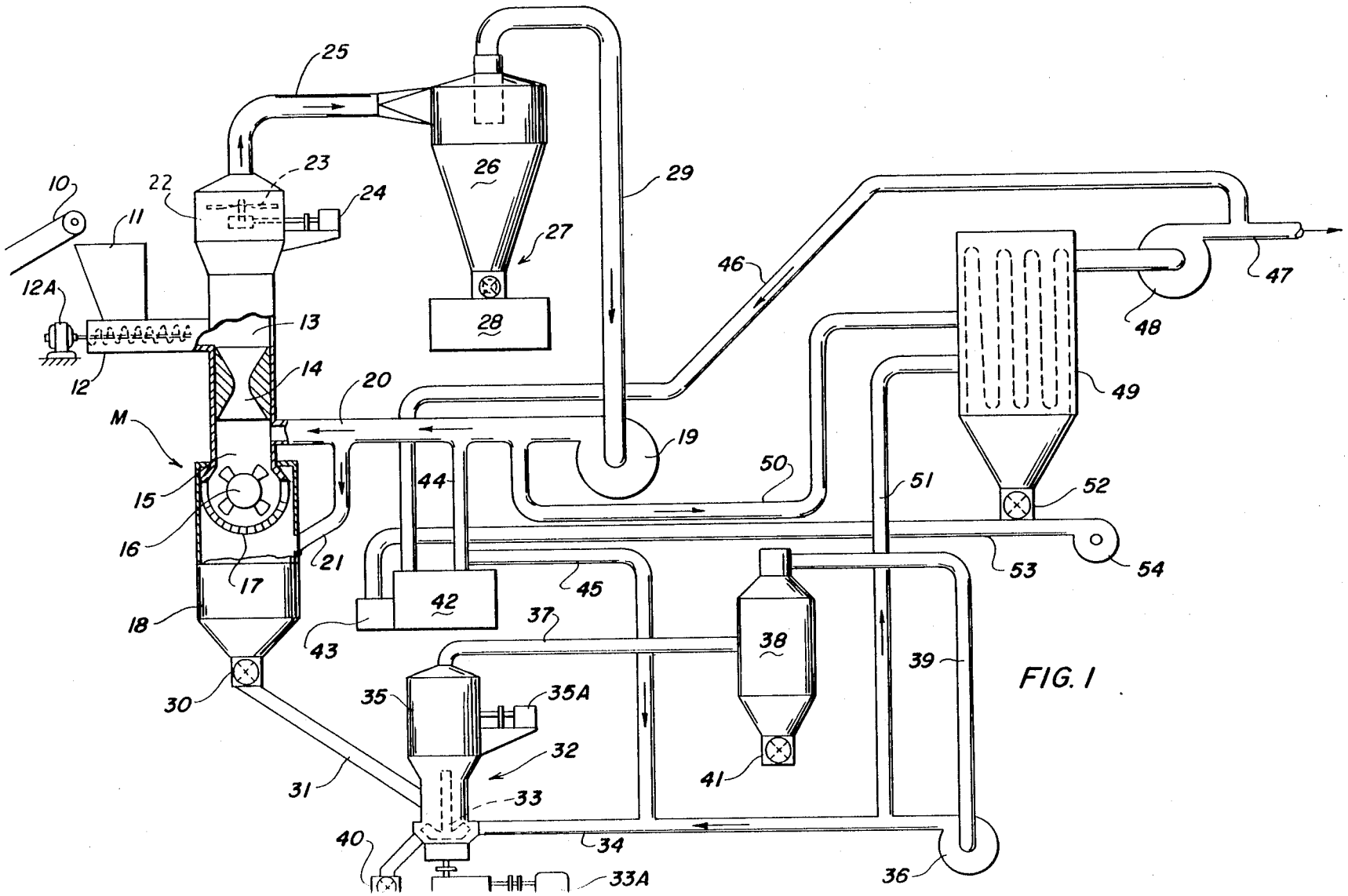

In the single schematic view of apparatus it is seen that the material to be processed is moved by conveyor 10 into hopper 11 where it can be fed by auger 12 operated by motor 12A into a column 13 where it can fall by gravity into and through a venturi throat 14 to reach the receiving inlet chamber 15 where an impact hammer rotor 16 in the housing of a mill M operates to break up the material. The mill is provided with a bottom grate

17 which allows for the coarse hard to grind particles to fall against air flow to strip off fines into a collector 18.

During the operation of the impact mill M, a primary air moving blower 19 is energized to create a flow of air through conduit 20 into the column 13 below the venturi throat 14, as well as into a branch conduit 21 for delivery to the mill below the grate 17. The air thus delivered to the mill M is intended to move the fine components of the material and any somewhat larger particles upwardly through column 13 to a separator 22 responsive to the air flow. The separator 22 includes a centrifugal member 23 driven by motor means 24 for the purpose of returning the excessively large particles to the mill for further reduction. The particles which pass the separator 22 are carried through conduit 25 to a cyclone separator 26 where the solid particles are extracted and collect at the rotary outlet valve 27 associated with a bin 28. The air now substantially free of particles returns by conduit 29 to the inlet of blower 19.

The impacted material which passes through grate 17 is stripped of fines by the air flow supplied from conduit 21 and falls into the mill collector 18. It is released through a rotary valve 30 to pass the conduit 31 into an air induced separator 32 where a rotary plow device 33, provided with a prime mover assembly 33A of known make-up, keeps lifting the material so the air stream delivered by conduit 34 lifts the material into a rotary separator 35 having an operating motor 35A for rotating a spinner device (not shown) which is similar to the centrifugal member 23 shown for the separator 22 associated with the mill M. The air flow in conduit 34 is generated by a blower 36 which creates circulation in conduit 37 from the separator 35 to the cyclone separator 38 before dropping substantial solid material prior to returning by conduit 39 to the blower 36. In this circuit, which is secondary to the first described circuit associated with blower 19, the heavy particles are continually agitated by the plow device 33 for further separation before being discharged out of the bottom of the rotary separator 32 at a rotary valve 40. The lighter solids separated at cyclone 38 are discharged through a rotary valve 41.

The first described circuit which includes the mill M and separator 22 first receives the very coarse material which is difficult to dry and normally not transportable in this circuit. But, by introducing the hard to dry material to the secondary system at separator 33 sufficient time is gained to allow for substantially complete drying of the surface moisture. The action of separator 32 is to confine the products so that they can be tumbled and stirred for exposing more of the surface to drying in the active bed of the separator 32 by the plow means 33 which cascades the material in a moving air column in which surface moisture is dried. The drying is accomplished by the circulation of heated air in conduit 34 from blower 36. The velocity of the air movement in separator 32 is controlled so that the heavy pyrites sink or gravitate to the outlet valve 40 where they can be extracted from the system.

An important condition for operation of the two circuits is that surface moisture needs to be controlled, and this is achieved by supplying heat to the circulating air. Thus surface moisture is dried or substantially reduced through the heat supplied by the operation of heater 42 which has a source of fuel 43, and discharges heated gases into stack 44 where it combines with the air flow in conduit 20 for effecting a drying function of the material being processed in the circuit which includes separator 22 and cyclone 26. Concurrently, hot gas is delivered to branch stack 45 where it combines with the flow in conduit 34 in the secondary circuit. The operation of the heater 42 can be augmented by air supplied through conduit 46 by tapping into the exhaust outlet 47 from the blower 48 which is connected into a bag house 49. This connection 46 allows the system to operate in a relative inert atmosphere.

The bag house 49 collects the fines which remain in the circulating air through being connected by conduit 50 which is tapped into the conduit 20 from blower 19, and by conduit 51 tapped into the conduit 34 from blower 36. Moreover, the operation of the bag house blower 49 places both the circuit associated with blower 19 and the circuit associated with blower 36 under a negative pressure condition. The use of rotary discharge valves 27, 30, 40, 41 and 52 at the bag house 49 assists in maintaining the negative pressure condition in such circuits.

The operation of the present embodiment of apparatus is particularly directed to processing coal which normally contains a certain amount of sulphur. The sulphur occurs in such forms as pyritic sulphur or sulphur combined with iron as pyrite or marcasite; organic sulphur combined with the coal substance; and sulphate sulphur combined with iron or calcium together with oxygen as iron sulphate or calcium sulphate. The present apparatus extracts the larger fractions of coal along with the pyrites from the means 13, 14, 16 and 22 which is in a first circulating and grinding and separating system, and then separates the pyrites from the desirable coal fractions by specific gravity evaluation in an air or gas fluid bed system 32 which develops a linear velocity of 3000 fpm for lifting the lighter weight coal from the heavier pyrites.

Thus, the dual circulating system effects separation of the coal into fines which are initially stripped away in the first system by an air or gas system prior to the grinding circuit having a linear velocity of 2000 fpm into larger fractions and pyrites which are subjected to specific gravity separation, and extreme fines or dust which is collected in a bag house 49. The extreme fines or dust can be deposited in a conduit 53 through valve 52 so that blower 54 can move it to the heater 42 where it will make up some of the fuel source.

The system is seen to be capable of processing material, such as coal, to produce a fine grade output at bin 28 from the first circuit, a second fine grade of material at the separator valve 41 in the second circuit and the hard to grind material at the outlet valve 40. Extreme fines can be used as a fuel to generate heat for drying purposes.

It can be appreciated from the foregoing disclosure that the presently preferred embodiment of apparatus for processing coal is rendered capable of extracting the extreme fines which may already be present in the coal as delivered for processing and which may be generated due to the handling of the coal in the apparatus, and in addition, extracts principal coal fractions and pyrites for subsequent separation in a specific gravity operation. The apparatus comprises in combination a first coal and air moving circuit containing the necessary components for processing the coal in an impact mill or the like, for supplying transporting air at the mill so that the fines can be stripped from the coal before it reaches the impact mill and after it has been subjected to the mill operation, and centrifugal separator means for clearing extreme fines from the air, which air is then returned to the impact mill. The apparatus also includes in the combination a second air moving circuit adapted to receive the principal coal fractions and pyrites from the first circuit and means therein to effect specific gravity separation of the principal coal fractions from the pyrites so that the pyrites can be discharged in one location and the principal coal fractions can be discharged separately therefrom. It is also important in the apparatus to at least surface dry the moisture from the coal during its processing in the impact mill and also during its specific gravity separation treatment so as to reduce, if not substantially eliminate, compacting of any small part of the coal which would impede its proper processing.

It should be understood that the foregoing description, while setting forth the presently preferred embodiment, is not to be unnecessarily limited, as variations may come to mind in view of the disclosure herein made.

What is claimed is:

1. An apparatus for processing coal to extract pyrites which are present in coal, the combination which comprises:

(a) a first coal and air moving circuit containing an impact mill for reducing coal and pyrites into fractions consisting of fines, principal coal and mixed coal and pyrites, a particle size control separator, a centrifugal separator, and blower means connected in series, said blower means creating the movement of air in said first circuit for transporting the fractions of coal fines initially present in the coal and created by the reduction of the coal by said impact mill into principal coal fractions and mixed coal and pyrites; and (b) a second coal and air moving circuit connected to said first circuit adjacent said impact mill to receive the mixed coal and pyrite fractions reduced by said impact mill, said second circuit containing air induced specific gravity separator means, a second centrifugal separator and second blower means connected in series, said specific gravity separator means being operable to agitate the mixed coal and pyrite fraction from said impact mill, and said specific gravity separator having an outlet for further separating pyrites from the mixed coal and pyrites and said second blower means effecting the movement of coal fractions and air in said second circuit to said second centrifugal separator, whereby said specific gravity separator effects the separation of heavy pyrite fractions out of the coal fractions through said outlet.

2. The apparatus set forth in claim 1 wherein said first circuit is formed with an inlet opening between said impact mill and particle size control separator to receive the coal and pyrites for processing, such that the movement of air in said circuit strips the fines initially present in the coal and pyrites prior to the coal and pyrites entering said impact mill.

3. The appartus set forth in claim 1 wherein said first circuit is formed with said impact mill having an outlet side for impacted mixed coal and pyrite fractions and an inlet side for the coal and pyrites to be processed; and wherein said blower means is connected into said impact mill at its said inlet and outlet sides for supplying air for transporting fines toward said centrifugal separator from both the inlet and outlet sides of said impact mill.

4. The apparatus set forth in claim 1 wherein a source of drying heat is connected into each of said air moving circuits for effecting drying of the coal therein.

5. The apparatus set forth in claim 1 wherein a bag house is connected into said first circuit for removing a portion of the air moving therein and maintaining said first circuit at a negative pressure relative to ambient pressure.

6. The apparatus set forth in claim 1 wherein said specific gravity separator means includes rotary means for agitating the principal coal fractions and pyrites for promoting the specific gravity separation thereof.

7. An apparatus for processing coal to extract pyrites from coal mixed with pyrites, said apparatus comprising:

(a) a coal reducing mill having a receiving inlet for coal mixed with pyrites at one side and a grate outlet at another side for reduced coal and pyrite;

(b) particle sizing means connected to said coal receiving inlet at a place beyond said receiving inlet;

(c) collector means adjacent said grate outlet to collect the reduced coal mixed with pyrites;

(d) first blower means having an outlet connected into said reducing mill at each said side of said reducing mill, and having an inlet connected to said particle sizing means;

(e) first separator means connected into said blower means inlet for separating coal fines out of the air moved by said blower means;

(f) specific gravity separator means having an inlet connected to said collector means to receive the collected reduced coal mixed with pyrites, and having spaced outlets;

(g) second blower means connected into said specific gravity separator means to supply air thereto, and having a return air inlet connected to one of said spaced outlets;

(h) second separator means inserted in said return air inlet of said second blower means; and (i) means in said specific gravity separator means operable for stirring and agitating the coal mixed with pyrites received from said collector means; whereby air supplied by said second blower transports coal into said specific gravity separator for effecting specific gravity separation of coal and pyrites such that the pyrites are gravity discharged at another of said spaced outlets.

* * * * *